US007764011B2

(12) United States Patent
Hong et al.

(10) Patent No.: US 7,764,011 B2
(45) Date of Patent: Jul. 27, 2010

(54) ELECTRON EMISSION DISPLAY DEVICE

(75) Inventors: Su-Bong Hong, Suwon-si (KR); Sang-Ho Jeon, Suwon-si (KR); Sang-Jo Lee, Suwon-si (KR); Sang-Hyuck Ahn, Suwon-si (KR)

(73) Assignee: Samsung SDI Co., Ltd., Yongin-si, Gyeonggi-do (KR)

( * ) Notice: Subject to any disclaimer, the term of this patent is extended or adjusted under 35 U.S.C. 154(b) by 775 days.

(21) Appl. No.: 11/545,541

(22) Filed: Oct. 11, 2006

(65) Prior Publication Data

US 2007/0085469 A1 Apr. 19, 2007

(30) Foreign Application Priority Data

Oct. 17, 2005 (KR) ..... 10-2005-0097699

(51) Int. Cl.

*H01J 19/02* (2006.01)
*H01J 19/24* (2006.01)
*H01J 1/62* (2006.01)
*H01J 1/30* (2006.01)

(52) U.S. Cl. ..... 313/497; 313/495; 313/310; 313/311

(58) Field of Classification Search ..... 313/495–497, 313/309–311

See application file for complete search history.

(56) References Cited

U.S. PATENT DOCUMENTS 5,786,659 A * 7/1998 Takagi et al. ..... 313/309
5,789,856 A * 8/1998 Itoh et al. ..... 313/495
5,838,095 A * 11/1998 Tanaka et al. ..... 313/309
6,072,272 A * 6/2000 Rumbaugh ..... 313/495
7,048,902 B2 5/2006 Gordeev et al.
7,098,705 B2 8/2006 Miyazawa
2001/0006325 A1 * 7/2001 Choi et al. ..... 313/495

(Continued)

FOREIGN PATENT DOCUMENTS

CN 1109205 9/1995

(Continued)

OTHER PUBLICATIONS

"Phosphor Handbook: 3.3 Practical Phosphor Table," Keikotai Dogakukai, 1st edition, Ohm-sha, Jun. 20, 1991, pp. 278-283.

(Continued)

*Primary Examiner*—Mariceli Santiago
(74) *Attorney, Agent, or Firm*—Robert E. Bushnell, Esq.

(57) ABSTRACT

An electron emission display device is constructed with first and second substrates facing each other, cathode electrodes formed on the first substrate, electron emission regions electrically connected to the cathode electrodes, and red, green and blue phosphor layers formed on a surface of the second substrate facing the first substrate. Each cathode electrode is constructed with a first electrode having opened portions arranged at the corresponding unit pixels defined on the first substrate with the same size, a second electrode spaced apart from the first electrode within the opened portion, and a resistance layer disposed between the first and the second electrodes to electrically interconnect the first and the second electrodes. The distance between the first and the second electrodes corresponding to the red, green and blue phosphor layers is established to be proportional to the light emission efficiency of the corresponding red, green and blue phosphor layers.

14 Claims, 3 Drawing Sheets

U.S. PATENT DOCUMENTS

| | | | | |
|---|---|---|---|---|
| 2002/0060514 | A1 | 5/2002 | Nakamoto | |
| 2004/0256969 | A1* | 12/2004 | Dijon et al. | 313/310 |
| 2007/0018553 | A1 | 1/2007 | Cho et al. | |
| 2009/0021143 | A1 | 1/2009 | Kim et al. | |
| 2009/0072707 | A1 | 3/2009 | Lee et al. | |

FOREIGN PATENT DOCUMENTS

| | | |
|---|---|---|
| CN | 1552084 | 12/2004 |
| JP | 02-247962 | 10/1990 |
| JP | 07-153369 | 6/1995 |
| JP | 09-092131 | 4/1997 |
| JP | 2000-100315 | 4/2000 |
| JP | 2000-251620 | 9/2000 |
| JP | 2005-243635 | 9/2005 |
| KR | 1020010013225 | 2/2001 |
| KR | 1020050050979 | 6/2005 |
| KR | 1020060012405 | 2/2006 |
| KR | 1020060114865 | 11/2006 |
| KR | 1020070011803 | 1/2007 |

OTHER PUBLICATIONS

Office action from Japanese Patent Office issued in Applicant's corresponding Japanese Patent Application No. 2006-282651 dated Jan. 26, 2010, and Request for Entry of the Accompanying Office Action for Japanese Office action attached herewith.

* cited by examiner

ELECTRON EMISSION DISPLAY DEVICE

CLAIM OF PRIORITY

This application makes reference to, incorporates the same herein, and claims all benefits accruing under 35 U.S.C. §119 from an application for ELECTRON EMISSION DISPLAY DEVICE earlier filed in the Korean Intellectual Property Office on 17 Oct. 2005 and there duly assigned Serial No. 10-2005-0097699.

BACKGROUND OF THE INVENTION

1. Field of the Invention

The present invention relates to an electron emission display, and in particular, to an electron emission display which corrects the discrepancy in light emission efficiency and luminance between red, green and blue phosphor layers.

2. Description of the Related Art

Generally, electron emission elements are classified, depending upon the kinds of electron sources, into a first type using a hot cathode, and a second type using a cold cathode.

Among the second typed electron emission elements using a cold cathode, are a field emission array (FEA) type, a surface-conduction emission (SCE) type, a metal-insulator-metal (MIM) type, and a metal-insulator-semiconductor (MIS) type.

The FEA-type electron emission element is typically constructed with electron emission regions, and cathode and gate electrodes as the driving electrodes for controlling the emission of electrons from the electron emission regions. The electron emission regions are made from a material having a low work function or a high aspect ratio. When an electric field is applied to the electron emission regions made from such a material under a vacuum atmosphere, electrons are easily emitted from those electron emission regions.

In an electron emission device, arrays of the electron emission elements are arranged on a first substrate of the electron emission display device. A light emission unit is formed on a second substrate constructed with phosphor layers and an anode electrode, which is assembled with the first substrate, thereby forming an electron emission display device.

In the electron emission display device, the red, green and blue phosphor layers are provided to the corresponding pixels, and the light emissions of the phosphor layers are controlled, thereby displaying the desired color images at the corresponding pixels. The light emissions of the red, green and blue phosphor layers are controlled by varying the number of electrons emitted from the electron emission regions corresponding to the corresponding phosphor layers.

The red, green and blue phosphor layers differ from each other in light emission efficiency and luminance due to the different characteristics of the materials from which each phosphor layer is made, even though the same number of electrons are colliding against the red, green and blue phosphor layers.

For instance, in order to display a white color image, the red, green and blue phosphor layers should emit the same amount of light. For this purpose, the same number of electrons are emitted from the electron emission regions corresponding to the red, green and blue phosphor layers, and hit the corresponding phosphor layers. The red, green and blue phosphor layers, however, do not emit the same amount of light due to the discrepancy in light emission efficiency and luminance between the red, green and blue phosphor layers so that the desired white color image cannot be obtained at the relevant pixel. And this problem deteriorates the screen display quality of the electron emission display.

In order to solve this problem, it has been contemporarily proposed that the amount of electron emissions corresponding to the corresponding phosphor layers should be controlled in the aspect of the driving circuit to correct the discrepancy in light emission efficiency and luminance between the different-colored phosphor layers. This proposal, however, complicates the driving circuit structure.

SUMMARY OF THE INVENTION

It is therefore an object of the present invention to provide an improved electron emission display device.

It is another object of the present invention to provide an electron emission display device which corrects the discrepancy in light emission efficiency and luminance between the different-colored phosphor layers, and simplifies the driving circuit structure.

These and other objects may be achieved by an electron emission display device constructed with the following features.

According to one aspect of the present invention, an electron emission display is constructed with first and second substrates facing each other, cathode electrodes formed on the first substrate, electron emission regions electrically connected to the cathode electrodes, and red, green and blue phosphor layers formed on a surface of the second substrate facing the first substrate. Each cathode electrode is constructed with a first electrode having opened portions arranged corresponding to each unit pixels defined on the first substrate with the same size, second electrodes formed within each opened portion of the first electrode and spaced apart from the first electrode, and resistance layers disposed between the first and the second electrodes to electrically interconnect the first and the second electrodes. The distance between the first and the second electrodes corresponding to the red, green and blue phosphor layers is established to be proportional to the light emission efficiency of the corresponding red, green and blue phosphor layers.

When the light emission efficiency of the red, green and blue phosphor layers is indicated by $E_R$, $E_G$ and $E_B$, respectively, and the distance between the first and the second electrodes corresponding to the red, green and blue phosphor layers is indicated by $G_R$, $G_G$ and $G_B$, respectively, the values of $E_R$, $E_G$ and $E_B$ and the values of $G_R$, $G_G$ and $G_B$ are established to simultaneously satisfy the following condition $$E_G > E_R > E_B \quad (1),$$

$$G_G > G_R > G_B \quad (2).$$

Particularly, the values of $E_R$, $E_G$ and $E_B$ and the values of $G_R$, $G_G$ and $G_B$ may be established to satisfy the following condition:

$$E_R:E_G:E_B = G_R:G_G:G_B.$$

It is possible that the first electrode contacts the electron emission region, and the second electrode surrounds the first electrode.

BRIEF DESCRIPTION OF THE DRAWINGS

A more complete appreciation of the invention and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENTS

The present invention will be described more fully hereinafter with reference to the accompanying drawings, in which preferred embodiments of the invention are shown.

Figure 1:
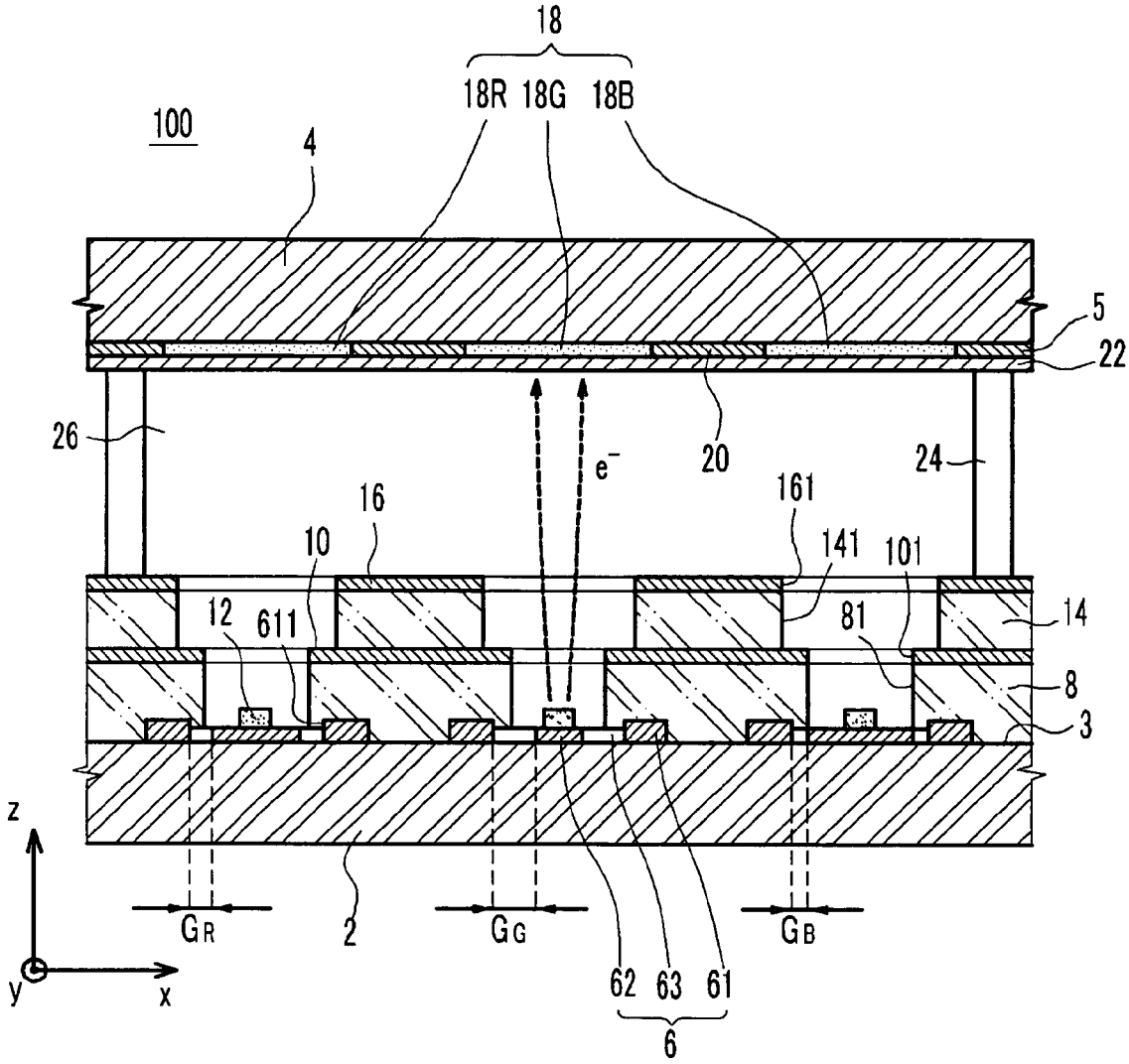
FIG. 1 is a partial cross-sectional view of an electron emission display constructed as an embodiment according to the principles of the present invention.
Figure 2:
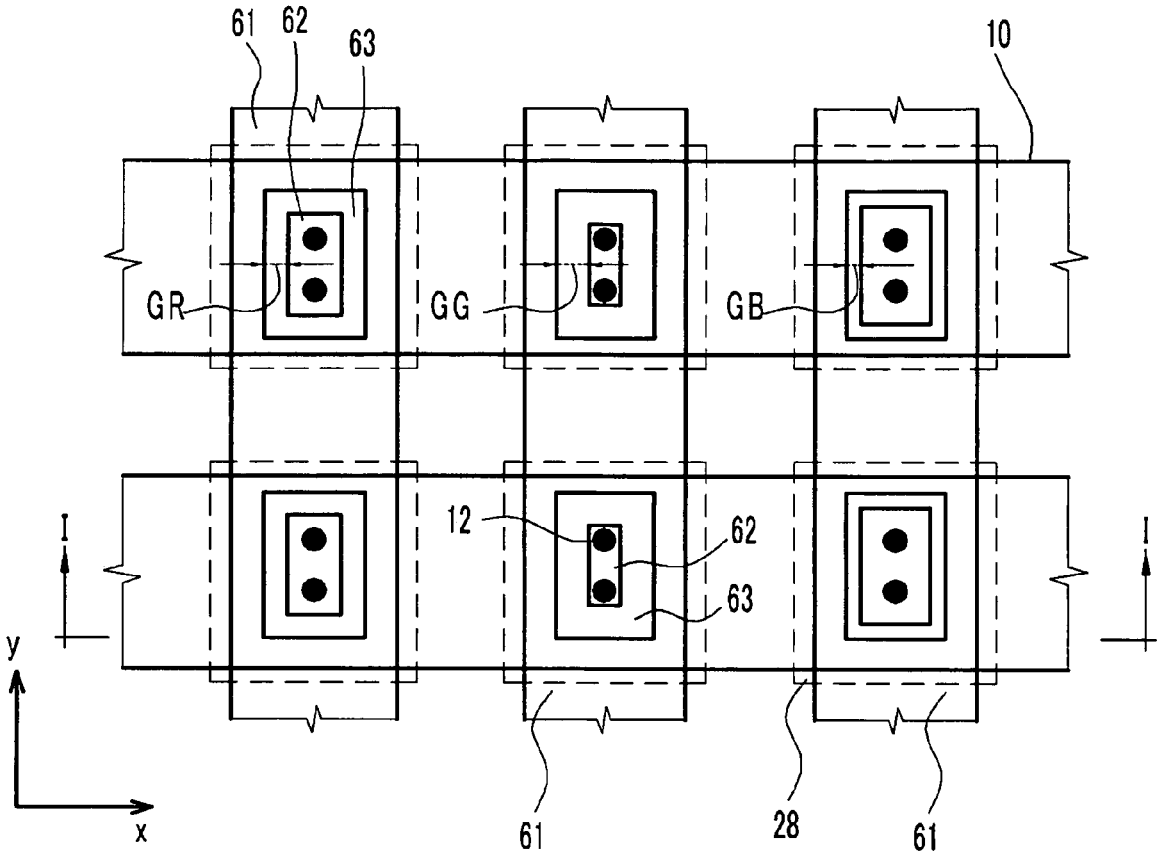
FIG. 2 is a partial plan view of the electron emission display constructed as the embodiment shown in FIG. 1.

FIG. 1 is a partial cross-sectional view of an electron emission display device constructed as a first embodiment according to the principles of the present invention, and FIG. 2 is a partial plan view of the electron emission display device illustrated by FIG. 1.

As shown in FIGS. 1 and 2, electron emission display device 100 is constructed with first and second substrates 2 and 4 facing each other in parallel and spaced apart from each other. First and second substrates 2 and 4 are sealed to each other at the peripheries of first and second substrates 2 and 4 by a sealing member (not shown) to form a vacuum sealed vessel 26, and vessel 26 is evacuated to reach a vacuum of approximately $10^{-6}$ Torr, thereby constructing a vacuum vessel 26.

An electron emission element includes electron emission region 12, cathode electrode 7 and gate electrode 10. Arrays of electron emission elements are arranged on surface 3 of first substrate 2 facing second substrate 4 to form an electron emission unit. A light emission unit including phosphor layers 18 and an anode electrode 22 is formed on surface 5 of second substrate 4 facing first substrate 2.

First substrate 2 with the electron emission unit and second substrate 4 with the light emission unit are assembled with each other to form an electron emission display device 100.

The above-structured vacuum vessel 26 may be applied to the FEA type, the SCE type, the MIM type, the MIS type, and other types of electron emission display devices. The FEA type electron emission display device will be exemplified, and specifically explained below.

A plurality of cathode electrodes 6 are stripe-patterned on first substrate 2 in a direction of first substrate 2 (in the y axis direction of FIG. 2).

A first insulating layer 8 is formed on the entire surface area of first substrate 2 such that first insulating layer 8 covers cathode electrodes 6. Gate electrodes 10 are stripe-patterned on first insulating layer 8 and extend perpendicularly to cathode electrodes 6 (in the x axis direction of FIG. 2).

Cathode and gate electrodes 6 and 10 form crossed regions 28, which are operated as unit pixels 28. Electron emission regions 12 are formed on cathode electrodes 6 corresponding to unit pixels 28.

In this embodiment, cathode electrode 6 is constructed with a first electrode 61, a second electrode 62, and a resistance layer 63.

First electrode 61 has opened portions 611 disposed at each unit pixel 28 with the same size. An island-shaped second electrode 62 is formed within each opened portion 611 such that it is spaced apart from first electrode 61. The distances between first and second electrodes 61 and 62 in both x and y axis directions are differentiated for each unit pixel 28, and detailed explanation will be made later.

First and second electrodes 61 and 62 may be made from a metallic material such as chromium (Cr). Alternatively, first and second electrodes 61 and 62 may be made from a transparent electrically conductive material.

A resistance layer 63 is disposed between first and second electrodes 61 and 62 to electrically interconnect them. In order to minimize the voltage drop along cathode electrode 6, resistance layer 63 may be made from a resistive material. Resistance layer 63 may be made from a material having a specific resistivity of between approximately 10,000 Ωcm and approximately 100,000 Ωcm, and commonly bears a resistance higher than that of the electrically conductive material-based cathode electrodes 61 and 62. For instance, resistance layer 63 may be made from p or n type doped amorphous silicon (Si).

First and second opened portions 81 and 101 are formed in first insulating layer 8 and gate electrodes 10, respectively, to expose electron emission region 12 on first substrate 2. That is, electron emission regions 12 are placed on cathode electrode 6 within first and second opened portions 81 and 101 of first insulating layer 8 and gate electrode 10, respectively. In this embodiment, electron emission region 12 and first and second opened portions 81 and 101 are planar circularly shaped, but the shape of electron emission region 12 and first and second opened portions 81 and 101 is not limited to this shape.

Electron emission regions 12 are made from a material emitting electrons when an electric field is applied to the material under a vacuum atmosphere, such as a carbonaceous material and a nanometer (nm) sized material. That is, electron emission regions 12 may be made from carbon nanotube, graphite, graphite nanofiber, diamond, diamond-like carbon, $C_{60}$ (fullerene), silicon nanowire, or a combination of these materials. Alternatively, electron emission regions 12 may be made from a sharp-pointed tip structure mainly based on molybdenum (Mo) or silicon (Si).

Electron emission regions 12 may be arranged at each unit pixel 28 in a plural manner, one example of which is illustrated in FIG. 2. The plurality of electron emission regions 12 may be spaced apart from each other and arranged serially in the longitudinal direction of either cathode 6 or gate electrodes 10, for example, in the longitudinal direction of cathode electrode 6, i.e. in the y axis direction. Of course, the arrangement of electron emission regions 12 in each unit pixel 28 is not limited to this arrangement, and may be altered in various manners.

A second insulating layer 14 and a focusing electrode 16 are sequentially formed on gate electrodes 10. Second insulating layer 14 is placed under focusing electrode 16 and is formed on the entire surface area of first substrate 2 such that second insulating layer 14 covers gate electrodes 10, thereby insulating gate and focusing electrodes 10 and 16 from each other.

Third and fourth opened portions 141 and 161 are formed in second insulating layer 14 and focusing electrode 16, respectively, to pass the electron beams.

Focusing electrode 16 may have opened portions 161 corresponding to either each electron emission region 12 to separately focus the electrons emitted from each electron emission region 12, or each unit pixel 28 to collectively focus the electrons emitted from each unit pixel 28. The latter case is illustrated in FIG. 2.

Discrete phosphor layers 18 including red, green and blue phosphor layers 18R, 18G and 18B are formed spaced apart on surface 5 of second substrate 4 facing first substrate 2. A black layer 20 is disposed between phosphor layers 18R, 18G and 18B to enhance the screen contrast. Phosphor layers 18R, 18G and 18B may be arranged in alignment with the corresponding unit pixels defined on first substrate 2, respectively.

An anode electrode 22 is disposed on phosphor and black layers 18 and 20 and is made from a metallic electrically conducting material such as aluminum (Al). Anode electrode 22 receives a high voltage required for accelerating the electron beams from the outside such that phosphor layers 18 are in a high potential state, and the visible light radiated from phosphor layers 18 to first substrate 2 is reflected by anode electrode 22 toward second substrate 4, thereby heightening the screen luminance.

Alternatively, anode electrode 22 may be made from a transparent conductive material such as indium tin oxide (ITO). In this case, the transparent anode electrode 22 is disposed between second substrate 4 and phosphor layers 18. It is also possible in an alternative embodiment that a metallic layer is provided in addition to the transparent, electrically conductive layer to function as anode electrode 22, thereby forming a light emission unit.

Spacers 24 are arranged between first and second substrates 2 and 4 to maintain the distance between first and second substrates 2 and 4 constant while enduring the pressure applied to the vacuum vessel 26.

Spacers 24 are arranged to correspond to focusing electrode 16 on the side of first substrate 2, and correspond to the area of black layer 20 on the side of second substrate 4 such that they do not block the areas of phosphor layers 18.

In this embodiment, the distance between first and second electrodes 61 and 62 is differentiated with respect to the corresponding red, green and blue phosphor layers 18R, 18G and 18B.

That is, in order to correct the discrepancy in light emission efficiency between the different-colored phosphor layers 18, distance $G_R$ between first and the second electrodes 61 and 62 corresponding to red phosphor layer 18R, distance $G_G$ between first and second electrodes 61 and 62 corresponding to green phosphor layer 18G, and distance $G_B$ between first and second electrodes 61 and 62 corresponding to blue phosphor layer 18B are established so as to be proportional to the light emission efficiencies of the corresponding phosphor layers 18.

Although the light emission efficiency is different for different phosphor layers 18 depending upon the materials of the components of each phosphor layer 18R, 18G or 18B, light emission efficiency $E_G$ of green phosphor layer 18G is the highest, and light emission efficiency $E_R$ of red phosphor layer 18R is the second highest, and light emission efficiency $E_B$ of blue phosphor layer 18B is the lowest. That is, $E_G>E_R>E_B$.

For instance, red phosphor layer 18R may be made from an oxide-based compound such as $Y_2O_3$:Eu, blue phosphor layer 18B may be made from an oxide-based compound such as $Y_2SiO_5$:Ce, and green phosphor layer 18G may be made from a sulfide-based compound such as ZnS:Cu.

When compared to the phosphor layer bearing a relatively low light emission efficiency, the phosphor layer bearing a relatively high light emission efficiency emits larger amount of visible lights and involves heightened luminance, even if the same number of electrons collides against both phosphor layers bearing a relatively high light emission efficiency and a relatively low light emission efficiency. Therefore, the electron emission region corresponding to the phosphor layer with a relatively high light emission efficiency should be established to emit a smaller number of electrons compared to the electron emission region corresponding to the phosphor layer with a relatively low light emission efficiency. That is, the discrepancy in light emission efficiency between the corresponding phosphor layers may be corrected by controlling the number of electrons emitted from the electron emission regions.

In this embodiment, the number of electrons emitted may be controlled by varying the distance between first and second electrodes 61 and 62. That is, the distance between first and second electrodes 61 and 62 can be reduced to increase the amount of electron emission, whereas the distance between first and second electrodes 61 and 62 can be enlarged to decrease the amount of electron emission.

Specifically, the distance between first and second electrodes 61 and 62 is controlled by varying the size of second electrode 62. As the same-sized opened portions 611 are formed in first electrodes 61 for each unit pixels 28, first electrodes 61 are even in size between unit pixels. By contrast, second electrodes 62 disposed within opened portions 611 of first electrodes 61 are enlarged or reduced in width, thereby controlling the distance between first and second electrodes 61 and 62.

Such a structure is made utilizing the principle that the distance between first and second electrodes 61 and 62 is proportional to the width of resistance layer 63, and the width of resistance layer 63 is proportional to the resistance of resistance layer 63, which is in turn inversely proportional to the amount of electric current flowing between first and second electrodes 61 and 62.

Based on the above principles, as shown in FIGS. 1 and 2, the inter-electrode distances corresponding to different phosphor layers 18 is gradually decreased in the sequence of green, red and blue phosphor layers 18G, 18R and 18B. That is, $G_G>G_R>G_B$.

Furthermore, with these different interelectrode distances, the ratio of light emission efficiency $E_R$ of red phosphor layer 18R to light emission efficiency $E_G$ of green phosphor layer 18G and to light emission efficiency $E_B$ of blue phosphor layer 18B may be established to be equal to the ratio of distance $G_R$ between first and second electrodes 61 and 62 corresponding to red phosphor layer 18R to distance $G_G$ between first and second electrodes 61 and 62 corresponding to green phosphor layer 18G and to distance $G_B$ between first and second electrodes 61 and 62 corresponding to blue phosphor layer 18B. That is, $E_R:E_G:E_B=G_R:G_G:G_B$.

Particularly, when red and blue phosphor layers 18R and 18B are made from an oxide-based compound and green phosphor layers 18G are made from a sulfide-based compound, the ratio in light emission efficiency of red phosphor layer 18R to green phosphor layer 18G and to blue phosphor layer 18B may be established to be 3:6:1. That is, $E_R:E_G:E_B=3:6:1$. Accordingly, the ratio of the distance between first and second electrodes 61 and 62 corresponding to red phosphor layer 18R to distance $G_G$ between first and second electrodes 61 and 62 corresponding to green phosphor layer 18G and to distance $G_B$ between first and second electrodes 61 and 62 corresponding to blue phosphor layer may be also established to be 3:6:1. That is, $G_R:G_G:G_B=3:6:1$.

In this embodiment, as the effective width of first electrode 61, through which the electric current is practically flowing, is the same for all cathode electrodes 6, the electric current characteristic such as a voltage drop is relatively the same for all cathode electrodes 6 compared to the case where the width of first electrode 61 varies.

Figure 3:
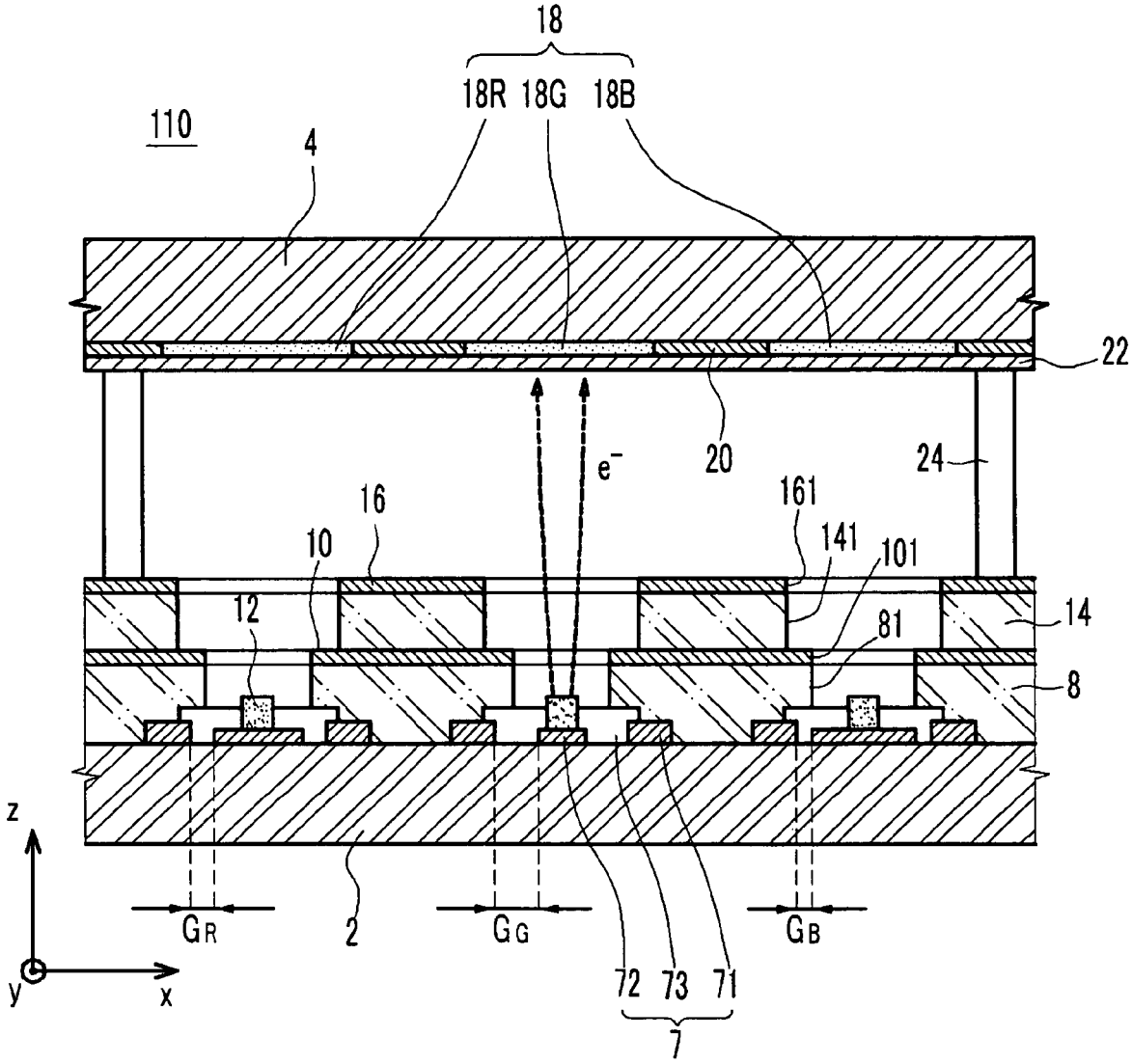
FIG. 3 is a partial cross-sectional view of an electron emission display constructed as another embodiment according to the principles of the present invention.

FIG. 3 is a partial cross-sectional view of an electron emission display device 110 constructed as a second embodiment according to the principles of the present invention. In electron emission display device 110 constructed as the present embodiment, resistance layer 73 not only interconnects first and second electrodes 71 and 72, but also contacts electron emission region 12. Consequently, the contact area between electron emission region 12 and cathode electrode 7 is enlarged to thereby increase the amount of electron emissions.

With a structure constructed according to the principles of the present invention, the width of the resistance layer of the cathode electrode may be controlled to correct the discrepancy in light emission efficiency and luminance between the different-colored phosphor layers, thereby enhancing the screen display quality, and simplifying the driving circuit structure because with this structure it is not necessary to make the correction in the aspect of the driving circuit.

Although preferred embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. An electron emission display device comprising:

first and second substrates facing each other;

a plurality of cathode electrodes formed on the first substrate;

a plurality of electron emission regions electrically connected to the cathode electrodes; and a plurality of red, green and blue phosphor layers formed on a surface of the second substrate facing the first substrate, with each cathode electrode being constructed with a first electrode having opened portions arranged at corresponding unit pixels defined on the first substrate having a same size, a second electrode being spaced apart from the first electrode and disposed within the opened portion, and a resistance layer disposed between the first and the second electrodes to electrically interconnect the first and second electrodes, and with the distances between the first and second electrodes corresponding to the red, green and blue phosphor layers being established to be proportional to the light emission efficiency of the corresponding red, green and blue phosphor layers, the light emission efficiencies of the red, green and blue phosphor layers are respectively indicated by $E_R$, $E_G$ and $E_B$, and the distances between the first and the second electrodes corresponding to the red, green and blue phosphor layers are respectively indicated by $G_R$, $G_G$, and $G_B$, the values of $E_R$, $E_G$ and $E_B$ and the values of $G_R$, $G_G$ and $G_B$ being established to satisfy the following condition:

$$E_R:E_G:E_B=G_R:G_G:G_B.$$

2. The electron emission display device of claim 1, comprised of the red and blue phosphor layers made from an oxide-based compound, and green phosphor layer made from a sulfide-based compound.

3. The electron emission display device of claim 2, with the ratio of $G_R:G_G:G_B$ being established to be 3:6:1.

4. The electron emission display device of claim 3, comprised of the resistance layer comprising amorphous silicon.

5. The electron emission display device of claim 1, comprised of the first and second electrodes being made from a metallic material.

6. The electron emission display device of claim 1, comprised of the second electrode contacting the electron emission region, and the first electrode surrounding the second electrode.

7. The electron emission display device of claim 6, comprised of the resistance layer contacting the electron emission region.

8. The electron emission region of claim 1, comprised of the first electrode being made from a transparent conductive material.

9. The electron emission region of claim 1, comprised of the electron emission regions being made from a material selected from the group consisting essentially of carbon nanotube, graphite, graphite nanofiber, diamond, diamond-like carbon, fullerene $C_{60}$, and silicon nanowire.

10. The electron emission display device of claim 1, further comprising gate and focusing electrodes disposed over the cathode electrodes such that the cathode, the gate and the focusing electrodes are insulated from each other.

11. An electron emission display device, comprising:

first and second substrates disposed in facing opposition;

a plurality of red, green and blue phosphor layers formed on a surface of the second substrate;

a plurality of cathode electrodes formed on the first substrate, with each cathode electrode being constructed with a first electrode having discrete opened portions within each unit pixel defined on the first substrate being substantially uniform in size, a second electrode being spaced apart from the first electrode and disposed within the opened portion, and a resistance layer electrically interconnecting the first and the second electrodes, with values of resistance between the first and second electrodes varying in proportion to light emission efficiencies of the corresponding red, green and blue phosphor layers; and a plurality of electron emission regions electrically connected to corresponding ones of the cathode electrodes and disposed in patterns in facing alignment with corresponding ones of the red, green and blue phosphor layers, the light emission efficiencies of the red, green and blue phosphor layers are respectively indicated by $E_R$, $E_G$ and $E_B$, and distances between the first and the second electrodes corresponding to the red, green and blue phosphor layers are respectively indicated by $G_R$, $G_G$ and $G_B$, the values of $E_R$, $E_G$ and $E_B$ and the values of $G_R$, $G_G$ and $G_B$ being established to satisfy the following condition:

$$E_R:E_G:E_B=G_R:G_G:G_B.$$

12. The electron emission display device of claim 11, comprising the resistance layers in a plurality of the cathode electrodes electrically interconnecting the corresponding second electrodes and electrode emission regions with the first electrode.

13. An electron emission display device, comprising:

first and second substrates disposed in facing opposition;

a plurality of red, green and blue phosphor layers formed on a surface of the second substrate;

a plurality of cathode electrodes formed on the first substrate, with each cathode electrode being constructed with a first electrode having discrete opened portions of substantially uniform size within each unit pixel defined on the first substrate, a second electrode spaced apart from the first electrode and disposed within the opened portion, and a resistance layer electrically interconnecting the first and the second electrodes, with the resistance layers establishing resistances to flow of electrical current between the first and second electrodes proportion to light emission efficiencies of corresponding red, green and blue phosphor layers; and a plurality of electron emission regions electrically connected to corresponding ones of the cathode electrodes and disposed in patterns in facing alignment with corresponding ones of the red, green and blue phosphor layers, the light emission efficiencies of the red, green and blue phosphor layers are respectively indicated by $E_R$, $E_G$ and $E_B$, and distances between the first and the second electrodes corresponding to the red, green and blue phosphor layers are respectively indicated by $G_R$, $G_G$ and $G_B$, the values of $E_R$, $E_G$ and $E_B$ and the values of $G_R$, $G_G$ and $G_B$ being established to satisfy the following condition:

$$E_R:E_G:E_B=G_R:G_G:G_B.$$

14. The electron emission display device of claim 13, comprising the resistance layers in a plurality of the cathode electrodes electrically interconnecting the corresponding second electrodes and electrode emission regions with the first electrode.

* * * * *